US005370261A

United States Patent [19]

Lin

[11] Patent Number: 5,370,261

[45] Date of Patent: Dec. 6, 1994

[54] MULTI-FUNCTION COVER FOR CANS

[76] Inventor: Chin-Fa Lin, No. 33, Pei-Shin, Sub-ward Pei-Shin, Shin-Hwa Chen, Tainan Hsien, Taiwan, Prov. of China

[21] Appl. No.: 120,515

[22] Filed: Sep. 14, 1993

[51] Int. Cl.[5] ..... B65D 17/44

[52] U.S. Cl. ..... 220/694; 220/277; 220/278

[58] Field of Search ..... 220/277, 278, 259, 694

[56] References Cited

U.S. PATENT DOCUMENTS

| | | | |
|---|---|---|---|
| 1,149,840 | 8/1915 | Lange | 220/278 |
| 1,462,783 | 7/1923 | Barbarou | 220/259 |
| 1,887,592 | 11/1932 | Goodfellow | 220/278 |
| 2,062,182 | 11/1936 | Kubitz | 220/278 |
| 2,578,979 | 12/1951 | McLean | 220/278 |
| 3,931,905 | 1/1976 | Shumway et al. | 220/278 |
| 5,025,945 | 6/1991 | Lyon | 220/278 |
| 5,094,361 | 3/1992 | Dubach | 220/277 |

*Primary Examiner*—David T. Fidei
*Attorney, Agent, or Firm*—Bacon & Thomas

[57] ABSTRACT

A multi-function cover is composed of a lid, a seat, and a fixture ring. The lid is pivotally attached to the seat at one end and has a circular groove at inner end for seating on a circular protuberance on the seat when the lid is closed. A cutter is formed at the inside of the seat and extends downward. A plurality of posts are formed at a bottom portion of the seat for insertion into holes on the fixture ring for connecting purposes. A circular groove is formed in the fixture ring for grasping the leading edge of a cap firmly.

3 Claims, 3 Drawing Sheets

MULTI-FUNCTION COVER FOR CANS

FIELD OF THE INVENTION

This invention relates to a multi-function cover for cans. More particularly, a cover is able to seal a soft drink aluminum can securely and to cut the top portion of the can off for another purpose when the can is empty.

BACKGROUND OF THE INVENTION

It has been a long time for the manufacturers of aluminum cans as well as many inventors trying to find out the best way to utilize empty cans. Some people cut them in pieces to form a lamp, or to form an art work. Many junk yards also collect empty cans and send to the factory for recycling. However, all such works are only part: of the function that an empty can may have, and there are many other functions which can be realized.

In view of this, the inventor has invented the present invention which is one of the other functions that is practical and economical.

SUMMARY OF THE INVENTION

It is the primary object of the present invention to provide a multi-function cover for can which has the merit of environmental controlling consideration.

It is another object of the present invention to provide a multi-function cover for can which corresponds to the principle of cost effective.

It is a further object of the present invention to provide a multi-function cover for can which is easy to use.

It is still a further object of the present invention to provide a multi-function cover which is less expensive to produce.

BRIEF DESCRIPTION OF THE PREFERRED EMOBDIMENT

DETAILED DESCRIPTION OF THE PREFERRED EMBODIMENT

Figure 1:
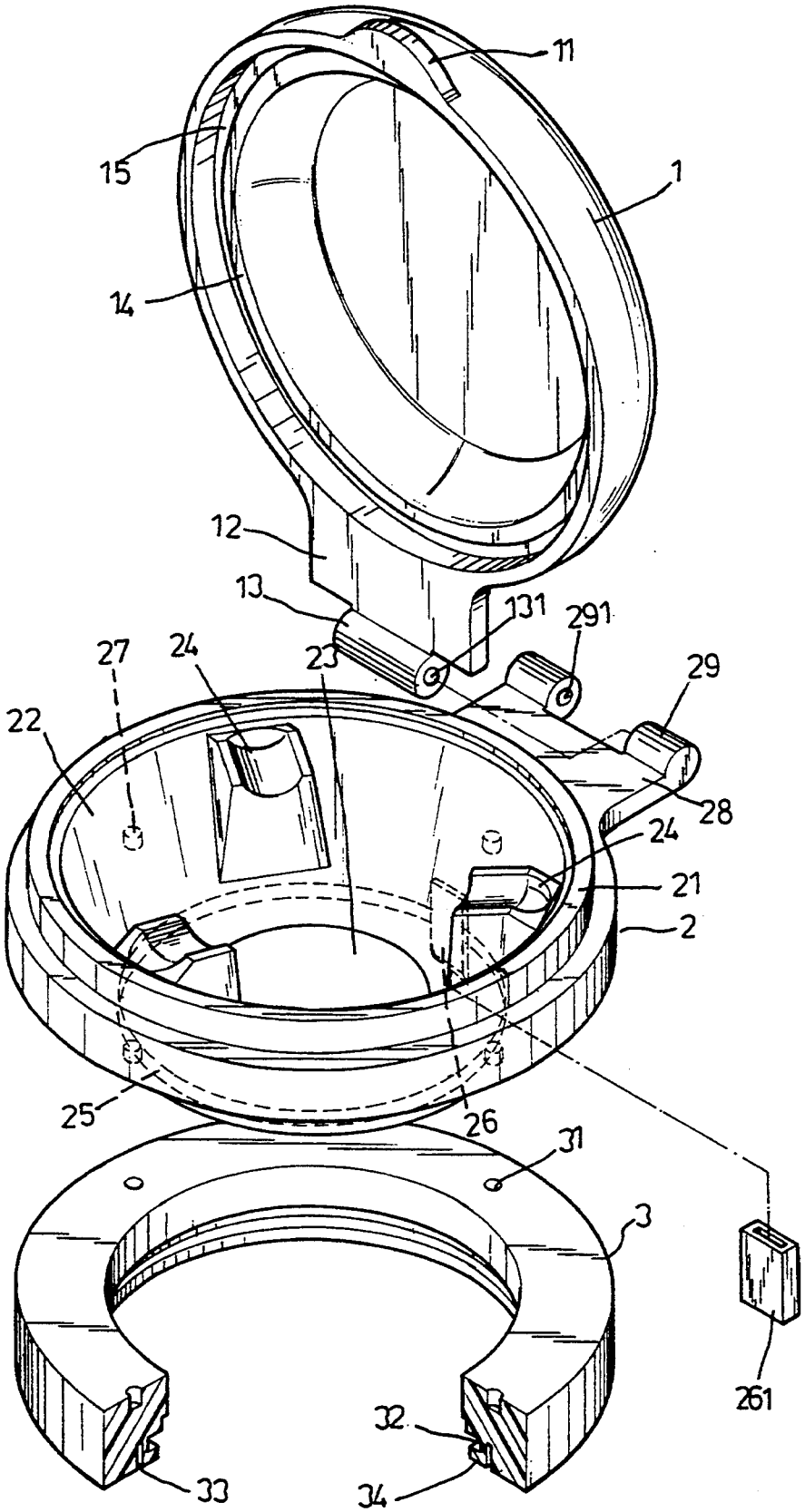
FIG. 1 is an exploded view of the present invention.
Figure 2:
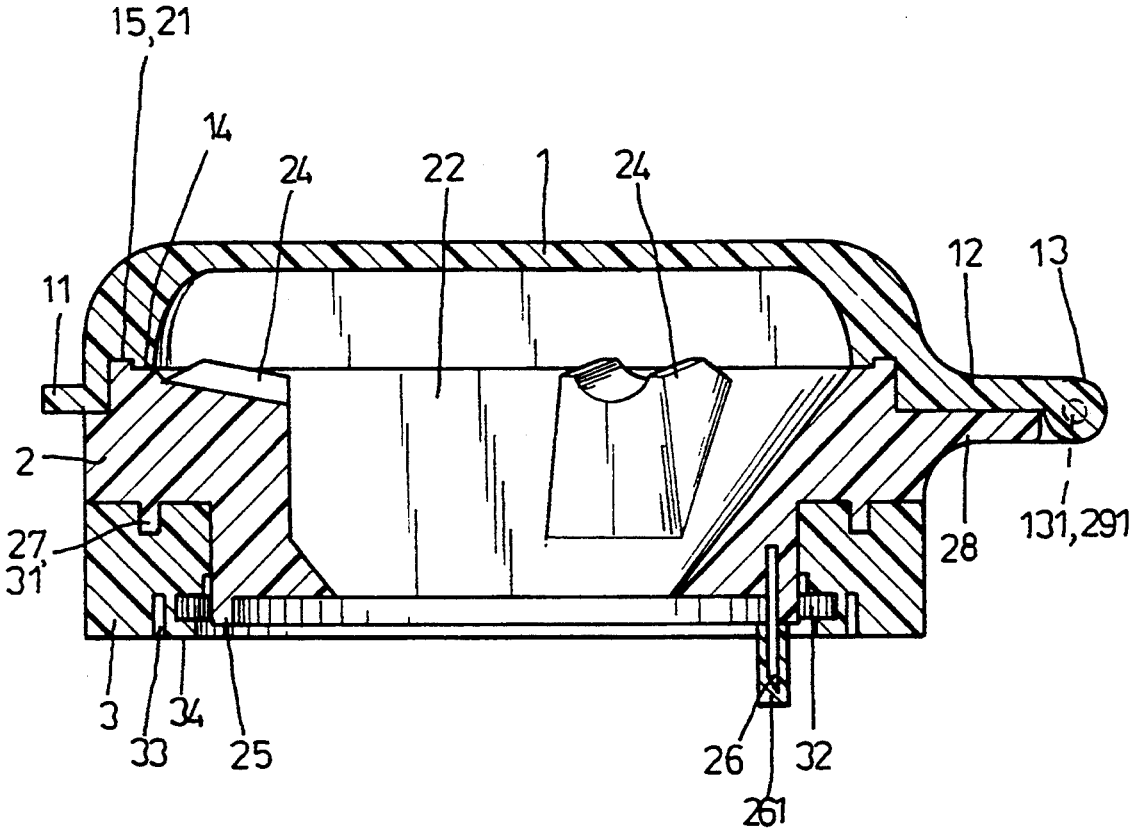
FIG. 2 is a side elevaation view of the present invention.
Figures 3A, 3B:
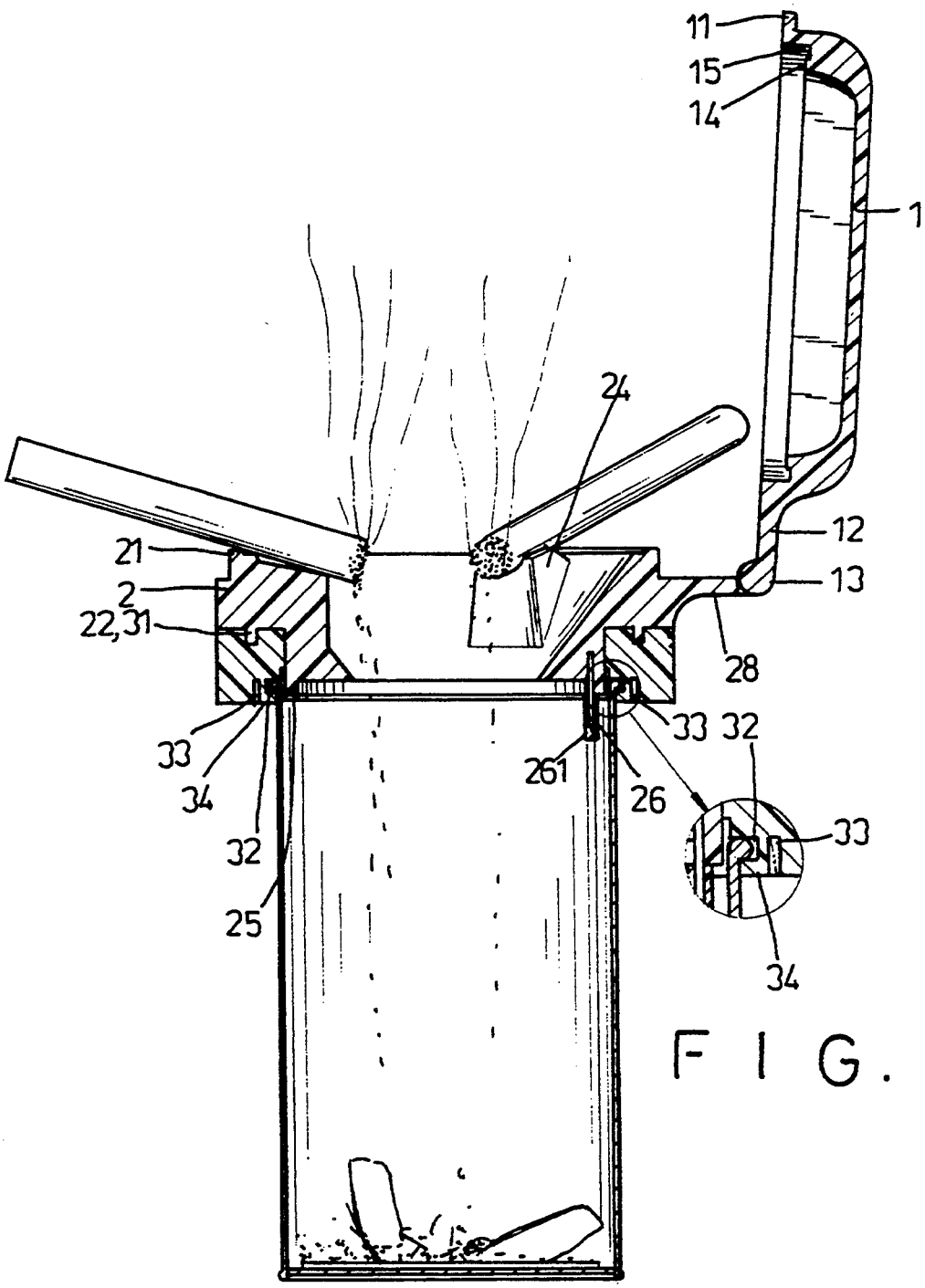
FIG. 3A is a partially cross sectioned side elevation view, showing the present invention mounted on a can.
FIG. 3B is an enlarged view taken from the circled area of FIG. 3A.

Referring now to the drawings wherein the showings are for the purpose of illustrating a preferred embodiment only and not for the purpose of limiting the same, FIG. 1 shows the present invention comprising generally a lid 1, a seat 2, and a fixture ring 3.

The lid 1 is circular in shape having a protrusion portion 11 at its leading edge adopted for users to push the protrusion portion 11 to open the lid 1, a lug 12 at opposite direction to the protrusion 11 on the leading edge, a connecing post 13 at the extremity 12 having a pair of protuberances 131 at respective ends thereof, a circular inner wall 14 at upper portion, and a groove 15 formed between the inner wall 14 and the lid 1.

The seat 2, circular in shape, has an extending wall 21 having a thickness slightly smaller than the size of the groove 15 of the lid 1, an inner wall 22 in conical shape with an poening 23 at bottom thereof, a plurality of cigarette holders 24, a ring 25 extending downward around the edge, a cutter 26 extending downward from the ring 25 having its edge covered with a scabbard 261. A number of posts 27 are formed at bottom and extending downward, a lug 28 is also formed at one side of the seat 2 and having a pair of lugs 29 at respective ends thereof and a dent 291 is formed at the inner end of each lug 29 adopted to receive the protuberances 131 of the lid 1.

The fixture ring 3 includes a number of holes 31 on top thereof adopted to receive a corresponding post 27 therein, a circular recess 32 adopted to receive the leading edge of a can, a notch 33, and a protruding ring 34 adopted to hold the leading edge of the can tight in the recess 32. The notch 33 is adopted to provide a flexibility of the protruding ring 34.

In operation, take off the seabbard 261, grasp the protruding ring of a can with the recess 32. The cutter 26 is inserted through the top cover. Holding the can and rotate the cap, the cutter 26 will gradually cut the top cover of the can until the entire cover is cut off and dropped into the can. The can, at this time, is able to be treated either as a trash can or as an ash tray.

I claim:

1. A multi-function cover for cans comprising:

a lid hingedly attached to a seat having a circular inner wall at an upper portion, and a circular groove in-between said lid and said inner wall;

a circular seat having an extending wall adapted to be inserted into said groove of said lid, an inner wall in conical shape with an opening at a bottom thereof forming a ring, a cutter extending downward from said inner wall of said seat;

a fixture ring having a circular recess at an inner portion thereof adapted to receive a leading edge of a can having a top, a notch, and a protruding ring adapted to hold the leading edge of said can in place, and being characterized in that, when said circular recess of said fixture receives the leading edge of the can from the outside thereof, said ring of said circular seat will engage with the edge from the inside thereof, and said cutter will be inserted through the top into the can and by turning the seat, the cutter will cut off the top of the can.

2. The multi-function cover of claim 1, wherein said lid includes a protrusion portion adapted for users to push open the lid, and a lug at an opposite position of said protrusion portion adapted to connect said lid to said circular seat in a hinged manner.

3. The multi-function cover of claim 1, wherein said circular seat includes at least two posts at a bottom portion thereof, and said fixture ring includes at least two corresponding holes on a top thereof adapted to receive said posts of said fixture ring therein.

* * * * *